US011788718B2

(12) United States Patent
Zheng et al.

(10) Patent No.: US 11,788,718 B2
(45) Date of Patent: Oct. 17, 2023

(54) LAMP

(71) Applicant: Hongbing Zheng, Zhejiang (CN)

(72) Inventors: Hongbing Zheng, Zhejiang (CN); Lei Bao, Zhejiang (CN); Lanyu Ye, Zhejiang (CN); Weifeng Jia, Zhejiang (CN)

(73) Assignee: Hongbing Zheng, Zhejiang (CN)

( * ) Notice: Subject to any disclaimer, the term of this patent is extended or adjusted under 35 U.S.C. 154(b) by 0 days.

(21) Appl. No.: 17/972,137

(22) Filed: Oct. 24, 2022

(65) Prior Publication Data

US 2023/0194071 A1 Jun. 22, 2023

(30) Foreign Application Priority Data

Dec. 17, 2021 (CN) ..... 202123187794.1

(51) Int. Cl.
*F21V 21/30* (2006.01)
*F21S 8/00* (2006.01)
*F21S 2/00* (2016.01)

(52) U.S. Cl.
CPC ..... *F21V 21/30* (2013.01); *F21S 2/005* (2013.01); *F21S 8/033* (2013.01)

(58) Field of Classification Search
CPC . F21V 21/30; F21V 17/06; F21S 8/033; F21S 2/005
See application file for complete search history.

(56) References Cited

U.S. PATENT DOCUMENTS

| | | | | |
|---|---|---|---|---|
| 7,824,068 | B2 * | 11/2010 | Wulfinghoff | F21S 6/003 362/249.03 |
| 9,695,996 | B2 * | 7/2017 | Dobbs | E01F 9/669 |
| 2009/0168422 | A1 * | 7/2009 | Chiu | F21V 21/30 362/249.03 |
| 2013/0271993 | A1 * | 10/2013 | Jan | F21V 14/02 362/249.1 |
| 2014/0268775 | A1 * | 9/2014 | Kennemer | B60Q 1/24 362/369 |
| 2017/0184293 | A1 * | 6/2017 | Chen | F21V 23/0471 |
| 2018/0195703 | A1 * | 7/2018 | Bailey | F21V 17/02 |
| 2022/0186914 | A1 * | 6/2022 | Frankl | F21V 21/06 |

* cited by examiner

*Primary Examiner* — William N Harris
(74) *Attorney, Agent, or Firm* — Muncy, Geissler, Olds & Lowe, P.C.

(57) ABSTRACT

The disclosure relates to a lamp in the technical field of illuminating, which includes more than two groups of illuminating devices, a plurality of groups of rotary connecting members, and a base mounting member. The more than two groups of illuminating devices are connected by the rotary connecting members, and each of the rotary connecting members includes a first rotating part and a second rotating part. The first rotating part is rotatably matched with the second rotating part, and the first rotating part and the second rotating part are detachably mounted on two adjacent groups of illuminating devices, and the more than two groups of illuminating devices are also mounted on the base mounting member, which has an advantage of an enlarged illuminating area, thus breaking through bottleneck of a smaller illuminating area of a single safety lamp.

13 Claims, 4 Drawing Sheets

LAMP

TECHNICAL FIELD

The disclosure relates to the technical field of illuminating equipment, in particular to a lamp.

BACKGROUND ART

As an alternative light source in modern living, working and other places, a LED lamp has been widely used because of its advantages of energy saving and long service life compared with traditional incandescent lamps. Therefore, LED technology has also been applied to many categories of lamps such as safety lamps, luminaires and floodlights. Nowadays, light emitting surfaces of most common LED safety lamp products are fixed and combined together, with a limited irradiation range; and one lamp can only illuminate at one area fixedly, with a limited use scene.

SUMMARY

In view of shortcomings in related art, a lamp is provided in the disclosure, which has an advantage of an enlarged illuminating area, thus breaking through bottleneck of a smaller illuminating area of a single safety lamp.

In order to solve the above technical problems, the present disclosure provides following technical solutions.

A lamp includes more than two groups of illuminating devices, a plurality of groups of rotary connecting members, and a base mounting member. The more than two groups of illuminating devices are connected by the rotary connecting members, and each of the rotary connecting members includes a first rotating part and a second rotating part. The first rotating part is rotatably matched with the second rotating part, and the first rotating part and the second rotating part are detachably mounted on two adjacent groups of illuminating devices, and the more than two groups of illuminating devices are also mounted on the base mounting member.

Optionally, the illuminating devices can be first illuminating lamps or second illuminating lamps, and at least one group of the first illuminating lamps is mounted on the base mounting member.

Optionally, the base mounting member includes a mounting base, a first rotating shaft, a rotating shaft intermediate member, a second rotating shaft and a plurality of groups of female end connectors. The first rotating shaft and a plurality of female end connectors are all mounted on the mounting base, the rotating shaft intermediate member is rotatably arranged on the first rotating shaft, and the second rotating shaft is rotatably arranged on the rotating shaft intermediate member.

Optionally, at least one of the first illuminating lamps is fixedly connected with the second rotating shaft.

Optionally, the lamp further includes a plurality of connecting wires. An end of one of the connecting wires is mounted on each second illuminating lamp, and an end of one of the connecting wires away from each second illuminating lamp is provided with a pin connector.

Optionally, the pin connectors are matched with a female end connectors.

Optionally, a housing of the connecting wire is made of flexible material.

Optionally, a suspension bracket is mounted on each of the groups of second illuminating lamps.

Optionally, the suspension brackets are rotationally matched with the second illuminating lamps.

Optionally, the lamp also includes an inductive controller mounted on the mounting base.

Compared with the prior art, the technical schemes provided in the disclosure have the following beneficial effects:

By providing the more than two groups of illuminating devices, a problem of a small illuminating area of the existing safety lamps is solved. Meanwhile, with detachable arrangement of the rotary connecting member, mounting flexibility of the second illuminating lamp is improved, and the second illuminating lamp can be directly mounted on a wall or mounted on the first illuminating lamp. When the second illuminating lamp is mounted on the first illuminating lamp, longitudinal adjustment of an illuminating direction can be made along with the first illuminating lamp, and transverse adjustment of the illuminating direction can be realized by rotating the connecting member, with a simple adjustment mode and enlarged illuminating area.

BRIEF DESCRIPTION OF THE DRAWINGS

In order to explain the embodiments of the present disclosure or the technical scheme in the prior art more clearly, the drawings required in the description of the embodiments or the prior art will be briefly introduced below; obviously, the drawings in the following description are only some embodiments of the present disclosure, and other drawings can be obtained according to these drawings by those of ordinary skill in the art without paying creative labor.

Reference numbers: 1. Illuminating Device; 2. Rotary Connecting Member; 3. Base Mounting Part; 4. First Rotating Part; 5. Second Rotating Part; 6. First Illuminating Lamp; 7. Second illuminating lamp; 8. Wiring Box; 9. Waterproof Gasket; 10, Suspension Bracket; 11. Spring Washer; 12. Mounting Hole; 13. Wire Protective Nut; 14. Housing; 15. Light Source Board; 16. Diffuser Plate; 17. Snap Spring Tab; 18. Mounting Base; 19. First Rotating Shaft; 20. Rotating Shaft Intermediate Member; 21. Second Rotating Shaft; 22. Female End Connector; 23. Connecting Wire; 24. Pin Connector; 25. Inductive Controller; 26. Power Board; 27. Waterproof Washer.

DETAILED DESCRIPTION

The present disclosure will be further described in detail with reference to the following examples which are explanation of the present disclosure and the present disclosure is not limited to the following examples.

Embodiment 1

Figure 1:
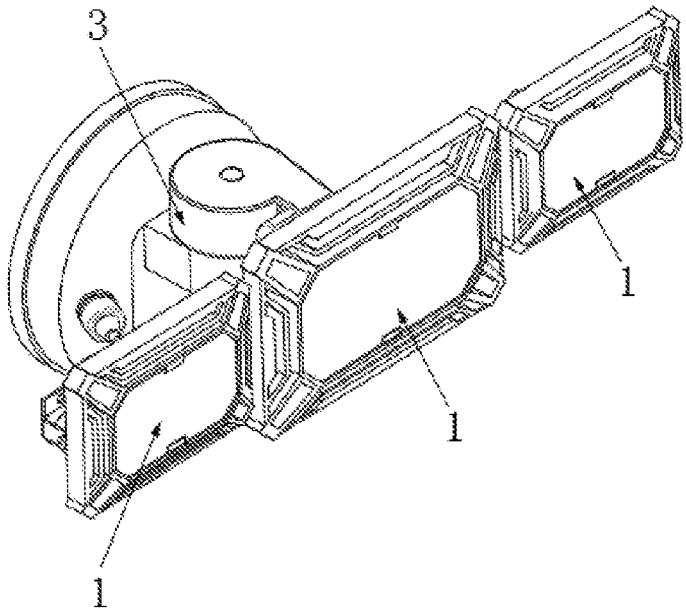
FIG. 1 is a perspective view of a lamp according to Embodiment 1.
Figure 6:
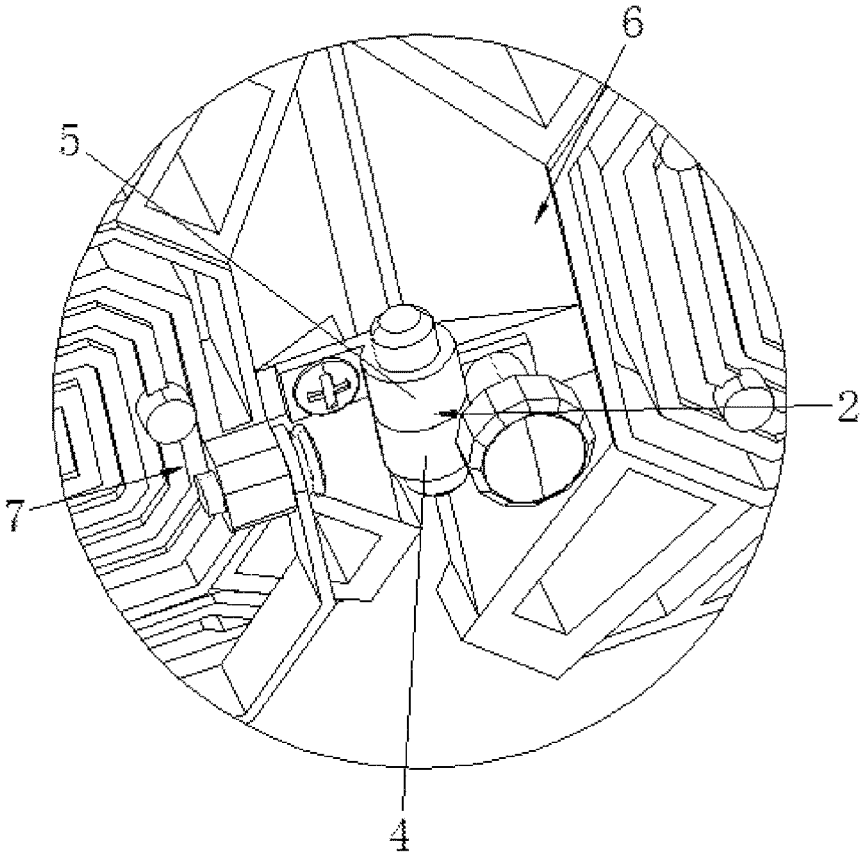
FIG. 6 is a structural diagram of a rotary connecting member of the lamp according to Embodiment 1.

As shown in FIG. 1 and FIG. 6, a lamp includes more than two groups of illuminating devices 1, a plurality of groups of rotary connecting members 2, and a base mounting member 3. The more than two groups of illuminating devices 1 are connected by the rotary connecting members 2, and each of the rotary connecting members 2 includes a first rotating part 4 and a second rotating part 5. The first rotating part 4 is rotatably matched with the second rotating part 5, and the first rotating part 4 and the second rotating part 5 are detachably mounted on two adjacent groups of illuminating devices 1, and the more than two groups of illuminating devices 1 are also mounted on the base mounting member 3.

A traditional safety lamp is set as a group of illuminating devices 1, but with shortcomings of a limited illumination range and illuminating in a single direction. For users, the small illumination range cannot realize required illumination effect, while the illuminating in the single direction makes it impossible for the users to illuminate in two directions at the same time, which makes actual use inconvenient and inflexible. However, in this disclosure, by providing the more than two groups of illuminating devices 1, the illumination range can be enlarged when required. In this embodiment, three groups of illuminating devices 1 are taken as an example for illustration.

Since the illuminating device 1 is a first illuminating lamp 6 or a second illuminating lamp 7, and at least one group of the first illuminating lamps 6 are mounted on the base mounting member 3, and the base mounting member 3 is mounted on a wall surface. In this embodiment, there is one group of the first illuminating lamps 6 and other two groups of the second illuminating lamps 7, and then the two groups of the second illuminating lamps 7 are respectively mounted on both sides of the first illuminating lamps 6 via the rotary connecting members 2. Specifically, the first rotating part 4 of the rotary connecting member 2 is fixed to the first illuminating lamp 6 by a screw, and the second rotating part 5 is fixed to the second illuminating lamp 7 by a screw. Therefore, in practical applications, an irradiation direction of the second illuminating lamp 7 can be manually adjusted transversely, so that an illuminating range of the first illuminating lamp 6 can be enlarged by transverse adjustment of the second illuminating lamp 7 while keeping its original illuminating range unchanged.

Figure 2:
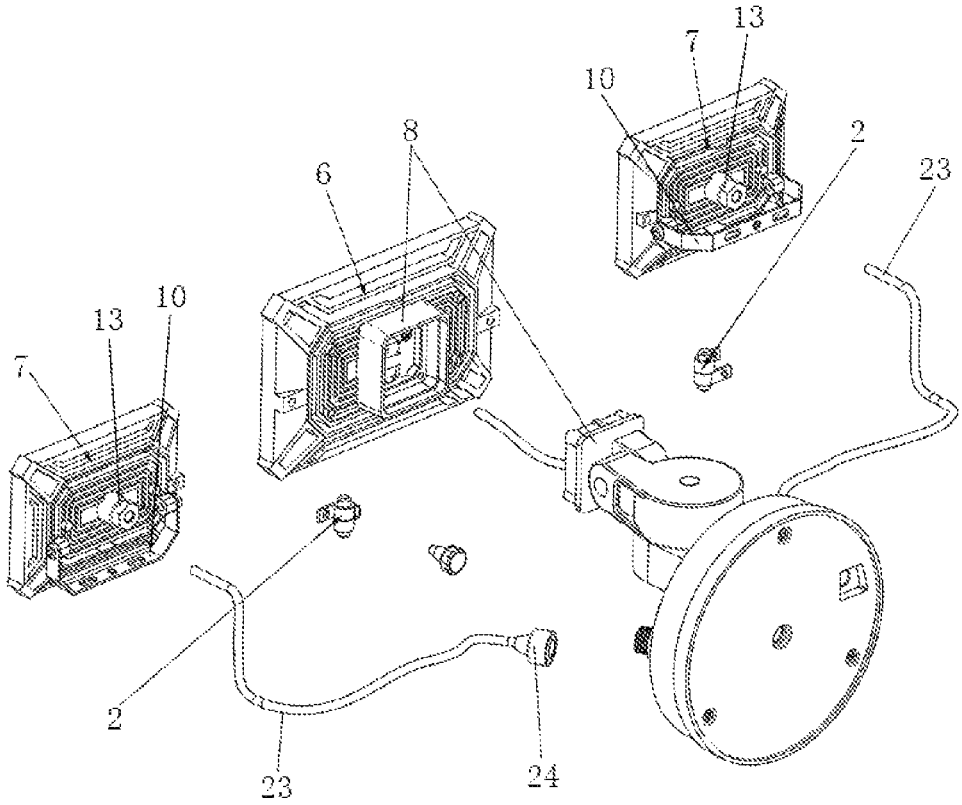
FIG. 2 is an exploded view of the lamp according to Embodiment 1.
Figure 3:
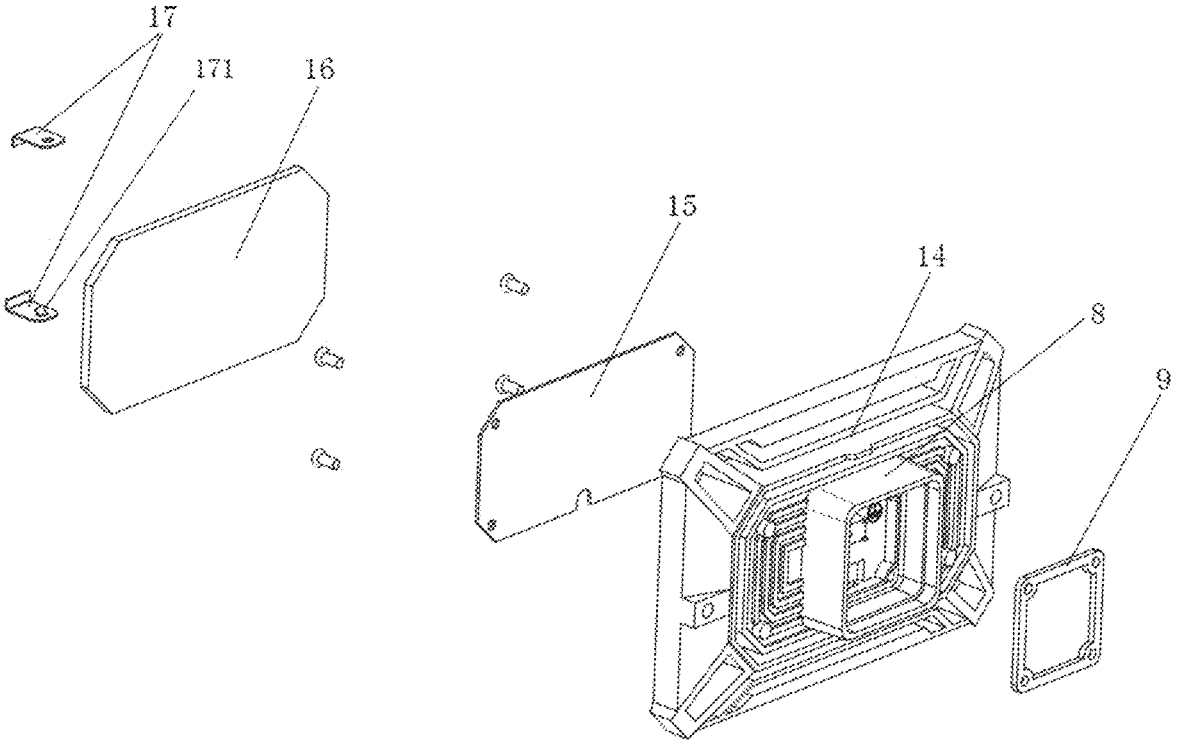
FIG. 3 is an exploded view of a first illuminating lamp of the lamp according to Embodiment 1.
Figure 5:
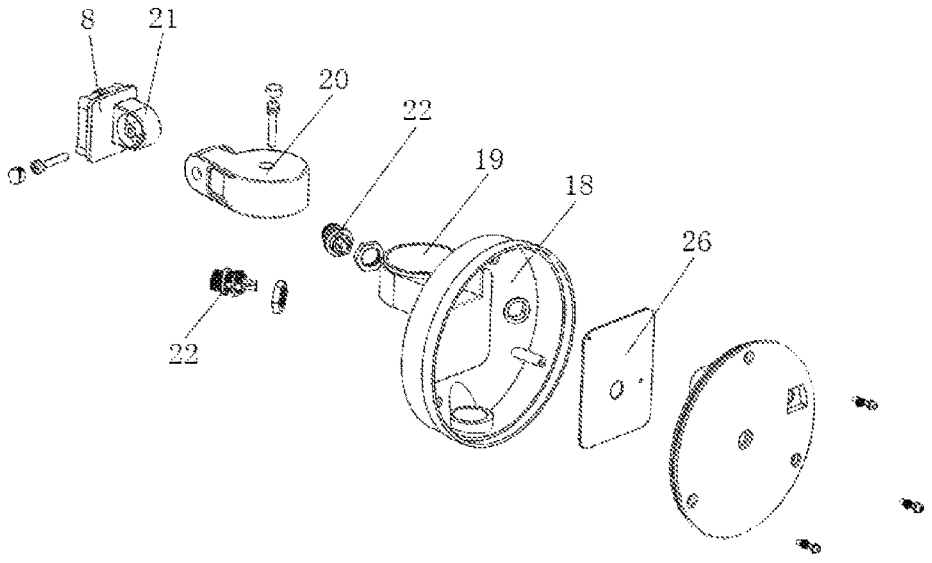
FIG. 5 is an exploded view of a base mounting part of the lamp according to Embodiment 1.

As shown in FIGS. 2, 3 and 5, the base mounting member 3 includes a mounting base 18, a first rotating shaft 19, a rotating shaft intermediate member 20, a second rotating shaft 21 and a plurality of groups of female end connectors 22. The first rotating shaft 19 and a plurality of groups of female end connectors 22 are all mounted on the mounting base 18, the rotating shaft intermediate member 20 is rotatably mounted on the first rotating shaft 19, the second rotating shaft 21 is rotatably mounted on the rotating shaft intermediate member 20, and the first illuminating lamp 6 is fixedly connected with the second rotating shaft 21. Specifically, a wiring box 8 is mounted on the first illuminating lamp 6, and a waterproof gasket 9 is provided in the wiring box 8, and the second rotating shaft 21 is fixedly connected with the wiring box 8, and a power board 26 is arranged in the mounting base 18.

In actual use, a situation exists in which an illumination direction of the first illuminating lamp 6 also needs to be adjusted. At this time, rotary fitting of the rotating shaft intermediate member 20 and the second rotating shaft 21 enables the first illuminating lamp 6 to rotate transversely, while rotary fitting of the rotating shaft intermediate member 20 and the first rotating shaft 19 enables the first illuminating lamp 6 to rotate longitudinally. Therefore, under action of the first rotating shaft 19, the rotating shaft intermediate member 20 and the second rotating shaft 21, both transverse and longitudinal adjustment of an illuminating direction can be realized for the first illuminating lamp 6. At this time, since the second illuminating lamp 7 is connected with the first illuminating lamp 6 via the rotary connecting member 2, an illuminating direction of the second illuminating lamp 7 may also be changed when direction adjustment is made to the first illuminating lamp 6. At this time, if the user feels that the illumination direction of the second illuminating lamp 7 needs to be adjusted, the second illuminating lamp 7 can be directly rotated to make the second illuminating lamp 7 rotate around the rotary connecting member 2, thus adjusting the illumination direction of the second illuminating lamp 7.

For powering for illuminating of the first illuminating lamp 6 and the second illuminating lamp 7, the power supply board 26 in the mounting base 18 is used for powering. Power lines of the first illuminating lamp 6 extend out of the wiring box 8, and into the mounting base 18 through the second rotating shaft 21, the rotating shaft intermediate member 20 and the first rotating shaft 19, and are connected with the power supply board 26, and the power lines are distributed in the wiring box 8, the second rotating shaft 21, the rotating shaft intermediate member 20 and the first rotating shaft 19. Therefore, the first illuminating lamp 6 can be powered, and the waterproof gasket 9 functions in waterproof protection of the power lines, thus preventing water leakage in the wiring box 8 from damaging the circuit, and functions in prolonging service life of the safety lamp.

A lamp further includes a connecting wire 23. An end of the connecting wire 23 is mounted on the second illuminating lamp 7, and an end of the connecting wire 23 away from the second illuminating lamp 7 is provided with a pin connector 24, and the pin connector 24 is matched with the female end connector 22, and a housing of the connecting wire 23 is made of a flexible material. Specifically, the flexible material can be a flexible insulating material such as PVC (polyvinyl chloride), PE (polyethylene), PUR (polyurethane), TPU (thermoplastic polyurethane elastomer rubber) and chlorinated polyethylene (CPE).

As for the second illuminating lamp 7, it is powered with the power board 26 in the mounting base 18 through the connecting wire 23. Specifically, an end of the connecting wire 23 is with a pin connector 24, and the pin connector 24 is matched with the female end connector 22. With provision of the pin connector 24 and the female end connector 22, mounting of the second illuminating lamp 7 can be facilitated, while the second illuminating lamp 7 can be powered off at any time. When the second illuminating lamp 7 needs maintenance, it can be powered off by directly pulling out the connecting wire 23, which ensures safety of maintenance and further improves convenience of maintenance. On the other hand, with provision of a flexible housing of the connecting wire 23, the second illuminating lamp 7 can be supported to a certain extent, which a position of the second illuminating lamp 7 can be varied at will.

Figure 4:
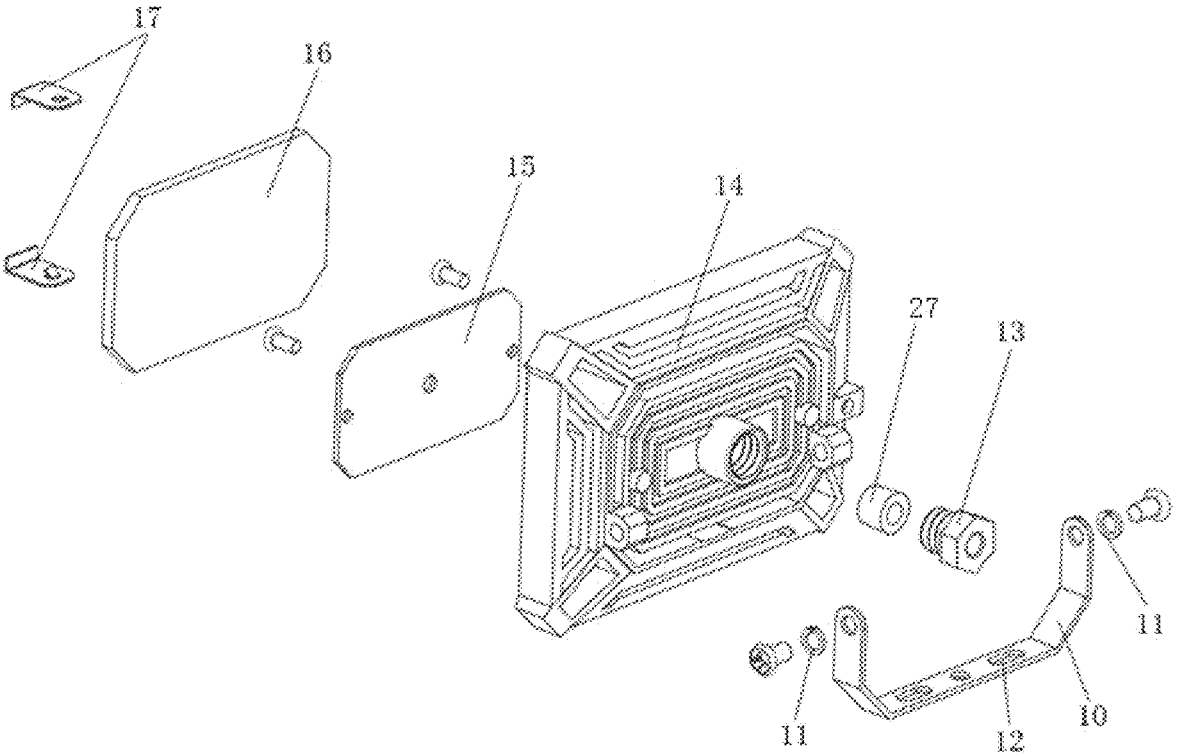
FIG. 4 is an exploded view of a second illuminating lamp of the lamp according to Embodiment 1.

As shown in FIGS. 2 and 4, the second illuminating lamp 7 is provided with a wire protective nut 13, and the waterproof washer 27 is arranged in the wire protective nut 13. In this disclosure, the wire protective nut 13 is hollow and configured for passing through the connecting wire 23.

The second illuminating lamp 7 is powered and connected to the power panel 26 through the connecting wire 23 to realize powering and illuminating. When the connecting wire 23 is connected with the second illuminating lamp 7, connection between the connecting wire 23 and the illuminating lamp is waterproofed through the wire protective nut 13 and the waterproof washer 27, so as to prevent water leakage at the connection from damaging the circuit, and play a protective role in circuit safety.

As shown in FIGS. 3 and 4, the first illuminating lamp 6 and the second illuminating lamp 7 each include a housing 14, a light source board 15, a diffuser plate 16 and more than two groups of snap spring tabs 17. The light source board 15 is fixed in the housing 14 by a screw, the more than two groups of snap spring tabs 17 are mounted in the housing 14, and the diffuser plate 16 is mounted on the housing 14 by the more than two groups of snap spring tabs 17. The housing 14 is made of a material with heat dissipation property, such as metal, which can serve to radiate heat in whole in a case of long-term illumination. In a normal illuminating process, after the light source board 15 is powered, light from the light source board 15 is diffused by the diffuser plate 16, thus realizing illumination. Meanwhile, the diffuser plate 16 is clamped in the housing 14 by the snap spring tab 17, thus with a convenient mounting and a reduced overall thickness of the illuminating lamp. Specifically, the snap spring tab 17 is a metal sheet with elastic deformation ability, and the diffuser plate 16 can be clamped with the housing 14 through elastic deformation of the snap spring tab 17. Meanwhile, a metal material can conduct heat, which can effectively guide the heat in the diffuser plate to the housing 14 thus realizing heat dissipation. The snap spring tabs 17 are arranged correspondingly in pairs, and the two corresponding snap spring tabs 17 are respectively provided with clamping legs 171 facing opposite to each other, which facilitates stable clamping between the snap spring tab 17 and the housing 14.

As shown in FIG. 4, a suspension bracket 10 is mounted on each group of the second illuminating lamps 7. The suspension bracket 10 is rotationally matched with the second illuminating lamps 7. Specifically, the suspension bracket 10 is mounted on the second illuminating lamps 7 by a fixing screw, and the fixing screw is sleeved with a spring washer 11, and the spring washer 11 is located between a head of a fixing screw and the suspension bracket 10, and at least one mounting hole 12 is defined in the suspension bracket 10.

As for the second illuminating lamp 7, besides being connected to the first illuminating lamp 6, the screw at the rotary connecting member 2 can be removed and mounted on the wall. Specifically, the screw of the first rotating part 4 or the second rotating part 5 can be removed to disconnect the first illuminating lamp 6 from the second illuminating lamp 7, and then an expansion screw can be passed through the mounting hole 12 and the suspension bracket 10 can be mounted on the wall. At this time, a mounting position of the second illuminating lamp 7 can be fixed according to actual needs of the user. On the other hand, because the fixing screw is sleeved with the spring washer 11, the suspension bracket 10 can be rotated under buffering effect of the spring washer 11. Therefore, the user can still adjust the illumination direction of the second illuminating lamp 7 longitudinally, making use of the illuminating lamp of the second illuminating lamp 7 more flexible.

In this embodiment, on and off of all of the first illuminating lamps 6 and the second illuminating lamps 7 are adjusted by a mechanical switch, that is, when the user needs illuminating, a mechanical switch button needs to be pressed, and when no illuminating is needed, the mechanical switch button also needs to be pressed. It can be selected according to actual needs of the user whether the first illuminating lamps 6 and the second illuminating lamps 7 are controlled using a same mechanical switch button at the same time, which is not limited in this embodiment, that is, the user can choose to control the first illuminating lamps and the second illuminating lamps separately or simultaneously.

Embodiment 2

Figure 7:
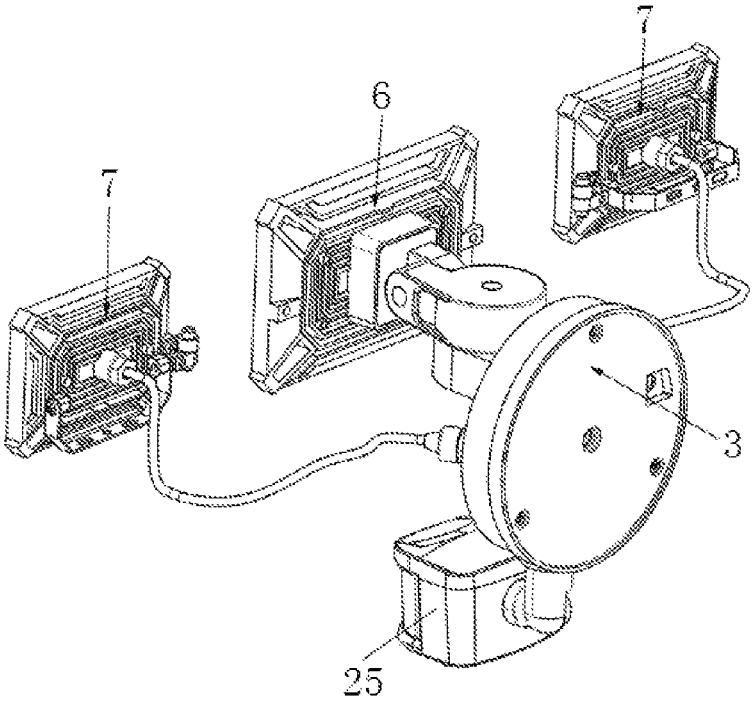
FIG. 7 is a perspective view of a lamp according to Embodiment 2.

As shown in FIG. 7, a lamp further includes an inductive controller 25. The inductive controller 25 is mounted on the mounting base 18. Difference between this embodiment and Embodiment 1 is that in this embodiment, an inductive enabling control mode is provided for the on and off of the first illuminating lamp 6 and the second illuminating lamp 7. Specifically, the inductive controller 25 can be any one of an infrared inductive switch, a voice control switch and a radar inductive switch, so as to realize automatic illumination control of the first illuminating lamp 6 and the second illuminating lamp 7 and improve convenience of illumination.

Furthermore, when the inductive controller 25 is used to realize the automatic illumination control, correspondingly, the first illuminating lamp 6 is connected with the mounting base 18 via communication lines in addition to the power lines, and the connecting line 23 also includes communication lines so as to realize intelligent illumination control. In addition, for the lamp according to this disclosure, the on and off of the first illuminating lamp 6 and the second illuminating lamp 7 can be controlled through WIFI intelligent controlling, remote controlling, microwave inductive, or other manners, which is not specifically limited in the embodiments of the present disclosure.

In addition, it should be noted that the specific embodiments described in this specification may have different shapes, names or the like of parts and components. Equivalent or simple changes made in accordance with the configurations, features and principles described in the inventive concept are included in the scope of protection of the disclosure. Various modifications, supplements or similar replacements can be made to the described specific embodiments by those skilled in the art to which the present disclosure pertains, which fall within the protection scope of the present disclosure without departing from the structure of the present disclosure or beyond the scope defined by the claims.

The invention claimed is:

1. A lamp, comprising more than two groups of illuminating devices, a plurality of groups of rotary connecting members, and a base mounting member, wherein the more than two groups of illuminating devices are connected by the rotary connecting members, and each of the rotary connecting members comprises a first rotating part and a second rotating part, the first rotating part being rotatably matched with the second rotating part and the first rotating part and the second rotating part being detachably mounted on two adjacent groups of illuminating devices; and the more than two groups of illuminating devices are also mounted on the base mounting member, wherein the illuminating devices are first illuminating lamps or second illuminating lamps, and at least one group of the first illuminating lamps is mounted on the base mounting member, and wherein the base mounting member comprises a mounting base, a first rotating shaft, a rotating shaft intermediate member, a second rotating shaft and a plurality of groups of female end connectors, the first rotating shaft and a plurality of female end connectors being all mounted on the mounting base, the rotating shaft intermediate member being rotatably arranged on the first rotating shaft, and the second rotating shaft being rotatably arranged on the rotating shaft intermediate member.

2. The lamp according to claim 1, wherein at least one of the first illuminating lamps is fixedly connected with the second rotating shaft.

3. The lamp according to claim 1, further comprising a plurality of connecting wires, an end of one of the connecting wires being mounted on each second illuminating lamp and an end of one of the connecting wires away from each second illuminating lamp being provided with a pin connector.

4. The lamp according to claim 3, wherein the pin connectors are matched with the female end connectors.

5. The lamp according to claim 3, wherein a housing of the connecting wire is made of flexible material.

6. The lamp according to claim 1, wherein a suspension bracket is mounted on each of the groups of second illuminating lamps.

7. The lamp according to claim 6, wherein the suspension brackets are rotationally matched with the second illuminating lamps.

8. The lamp according to claim 1, further comprising an inductive controller mounted on the mounting base.

9. The lamp according to claim 7, wherein the suspension bracket is mounted on the second illuminating lamps by a fixing screw, and the fixing screw is sleeved with a spring washer, and the spring washer is located between a head of a fixing screw and the suspension bracket, and at least one mounting hole is defined in each suspension bracket.

10. The lamp according to claim 3, wherein the second illuminating lamps are provided with a wire protective nut, and the wire protective nut is hollow and the connecting wire is configured for passing through the wire protective nut.

11. The lamp according to claim 1, wherein the first illuminating lamps and the second illuminating lamps each include a housing, a light source board, a diffuser plate and more than two groups of snap spring tabs, the light source board is fixed in the housing by a screw, the more than two groups of snap spring tabs are mounted in the housing, and the diffuser plate is mounted on the housing by the more than two groups of snap spring tabs.

12. The lamp according to claim 11, wherein each snap spring tab is a metal sheet with elastic deformation ability.

13. The lamp according to claim 12, wherein the snap spring tabs are arranged correspondingly in pairs, and the two corresponding snap spring tabs are respectively provided with clamping legs facing opposite to each other, which facilitates stable clamping between the snap spring tab and the housing.

* * * * *